US005860297A

United States Patent [19]

Masucci

[11] Patent Number: 5,860,297

[45] Date of Patent: Jan. 19, 1999

[54] BOTTLE CAP JEWELRY

[76] Inventor: Thomas M. Masucci, 4061 Yerba Buena Ave., San Jose, Calif. 95121

[21] Appl. No.: 837,610

[22] Filed: Apr. 21, 1997

[51] Int. Cl.[6] ..... A44C 25/00

[52] U.S. Cl. ..... 63/33; 63/13; 63/21; 63/34

[58] Field of Search ..... 63/12, 13, 14.1, 63/14.2, 14.3, 14.5, 14.6, 14.7, 14.8, 20, 21, 22, 23, 34; 29/896.4, 896.41, 896.43

[56] References Cited

U.S. PATENT DOCUMENTS 256,056 4/1882 Royce et al. ..... 63/20
509,888 12/1893 Gaynor ..... 63/23
735,891 8/1903 Malliet ..... 63/13
5,572,886 11/1996 Katz ..... 63/2

*Primary Examiner*—Kien T. Nguyen
*Attorney, Agent, or Firm*—John J. Leavitt

[57] ABSTRACT

An article of manufacture fabricated from discarded, recycled and new bottle caps of the type conventionally used to seal soft drink and beer bottles. A bottle cap is placed on a supporting surface and pressed substantially flat to form a wafer having an irregular surface and an irregular perimeter. The surfaces of the wafer are decoratively coated with powdered metal, pigmented enamel or ceramic. A suspension device is attached to the decorated wafer to enable suspension of the article of manufacture.

2 Claims, 1 Drawing Sheet

BOTTLE CAP JEWELRY

BACKGROUND OF THE INVENTION

1. Field of the Invention

This invention relates to jewelry, and more particularly to earrings and pendant-type jewelry fabricated from bottle caps, both new and used.

2. Field of the Prior Art

It appears that since the beginning of time, mankind has adorned itself with all manner of jewelry. Thus, items of transparent glass, colored glass, bones, metal of various types and shapes, and of course diamonds, have been utilized for adornment of the human body. So far as I know however, nobody has attempted to utilize a common metallic bottle cap to fashion an attractive piece of jewelry or pendant for adornment of the human body.

A preliminary patentability and novelty search has revealed the existence of the following U.S. Pat. Nos.:

| | | |
|---|---|---|
| 2,076,387 | 3,959,527<br>4,761,971 | 4,201,456 |

U.S. Pat. No. 3,959,527 discloses the fabrication of flat costume jewelry from initially flat metal sheets through use of photofabrication mass production techniques. The end product and method of fabrication taught by this patent is therefore significantly different from the product and method of fabrication disclosed herein.

Silber U.S. Pat. No. 4,202,456 teaches merely that bottle caps in substantially their original form may be joined together and used as building blocks for the fabrication of toys.

Stupell U.S. Pat. No. 2,076,387 teaches the formation of numerous selected designs on a strip of metal, and the application of adhesive to one side to enable adherence to a supporting structure.

Freier U.S. Pat. No. 4,761,971 teaches the coating of metal earrings with plastic to prevent irritation of the wearer's skin by the metal.

Accordingly, it is one of the important objects of the present invention to utilize discarded bottle caps of the type that are commonly used on carbonated drinks and beer bottles from which to fashion an attractive piece of jewelry.

Another object of the invention is to provide a piece of jewelry fabricated from a discarded or new bottle cap that may indicate by its appearance the object from which it was fabricated.

A still further object of the invention is to develop a method of treatment of the discarded and new bottle caps of the type indicated to form an attractive and colorful piece of jewelry, whether it be an earring-type of jewelry or a pendant.

The invention possesses other objects and features of advantage, some of which, with the foregoing, will be apparent from the following description and the drawings. It is to be understood however, that the invention is not limited to the embodiment illustrated and described since it may be embodied in various forms within the scope of the appended claims.

SUMMARY OF THE INVENTION

In terms of broad inclusion, the bottle cap jewelry of the invention comprises an ornamental wafer suitably formed and colored, i.e., painted, glazed or otherwise coated with an attractive coating, to partially or selectively totally obscure the fact that the piece of jewelry has been fabricated from a discarded or new bottle cap. Attached to the wafer, is a clasp or suspension device which can be of the type that is applicable to the earlobe of the human body, or which may be utilized as a pin for suspending the pendant on the clothing of the wearer. In another aspect, the invention includes the method of converting a discarded or new bottle cap into an article of jewelry.

DESCRIPTION OF THE PREFERRED EMBODIMENTS

Figure 1:
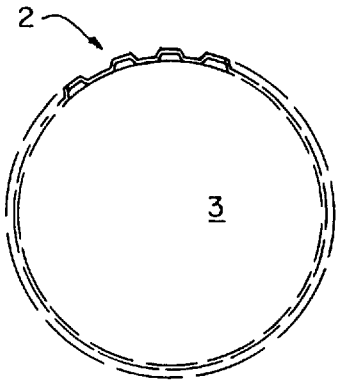
FIG. 1 is a plan view of the inside of a conventional bottle cap of the type that is press-fitted and crimped onto soft drink and beer bottles.
Figure 2:
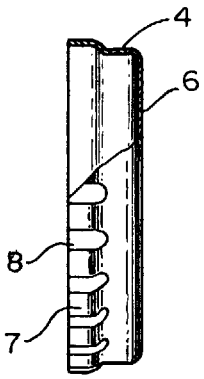
FIG. 2 is an edge view of the bottle cap illustrated in FIG. 1.

In terms of greater detail, and referring to the drawings, particularly FIGS. 1 and 2, it will be seen that FIG. 1 illustrates the interior of a bottle cap designated generally by the numeral 2, and comprising the type of bottle cap that is utilized to seal the opening of soft drink and beer bottles, and other types of liquids contained and dispensed from bottles. The bottle cap illustrated normally comes equipped with a soft resilient seal structure (not shown) adhered to the inner surface 3 of the bottle cap, but for the purposes of this invention, that soft resilient seal structure, if present, is removed. For use as a bottle cap, to seal the opening in soft drink and beer bottles, the bottle cap is provided with a generally cylindrical portion 4 integral with a flat top portion 6, and a flared skirt portion 7 that is formed with indentations 8 that are formed by crimping the skirt portion 7. In the application of the conventional bottle cap to a bottle, appropriate equipment squeezes the cap down on the opening of the bottle, and presses the crimped flange 7 about an appropriate circular ridge on the bottle.

Figure 3:
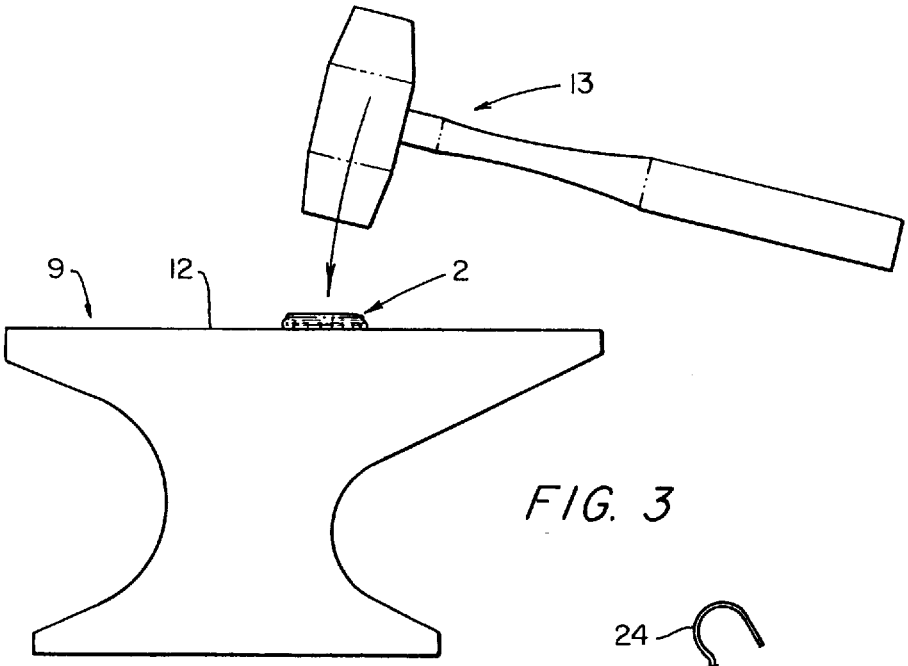
FIG. 3 is a composite view illustrating the manner in which a metallic wafer is formed from a discarded or new bottle cap.

For the purposes of this invention, the configuration of the bottle cap is modified by the application of a crushing force, as illustrated in FIG. 3. Preferably, a discarded or new bottle cap is placed on an anvil designated generally by the numeral 9, and including a top surface 12 on which the bottle cap is placed flange portion 7 down and end wall 6 up. Pressure is then applied to the bottle cap perpendicular to surface 12 by an appropriate means, including manually through use of a hammer designated generally by the numeral 13. Obviously, the anvil 9 may be any type of support structure having a flat surface on which a bottle cap or multiple bottle caps may be aligned or placed, and the pressure applying means for flattening the bottle cap may be any type of pressure applying structure, for instance, a hydraulic press, (not shown) instead of the hammer that is illustrated.

Figure 4:
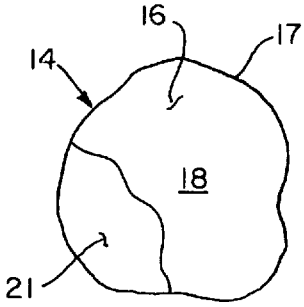
FIG. 4 is a plan view of the bottle cap after it has been compressed into a flat wafer.
Figure 5:
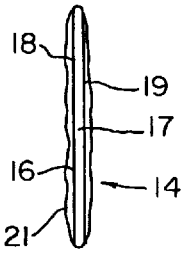
FIG. 5 is an edge view of the wafer illustrated in FIG. 4.

The end result of the application of pressure to the bottle cap 2 is to create a metal wafer designated generally by the numeral 14 and illustrated in FIG. 4. The wafer as there illustrated comprises a flat body 16 having an irregular marginal edge 17 created by the flange portion 7 sometimes being pressed inwardly into an overlapping relationship with the top and generally occupying a common plane, and sometimes being pressed outwardly so as to create the overall peripheral and surface irregularity of the wafer. It has been found that the pressing operation generally results in no two of the wafers being the same shape. Thus, each is individualized, with the crimp portion of the flange 7 sometimes appearing, as illustrated in FIG. 4 and sometimes being only partially discernible as a surface irregularity. Each of the wafers 14 is of course provided with generally flat opposite surfaces 18 and 19 as illustrated in FIGS. 4 and 5, and these surfaces are utilized for the application of a decorative-type of coating 21, which may be powdered metal, or an appropriately pigmented enamel, or variations of different types of enamels in different colors, or it may be a heat glazed-type material such as ceramic that is bonded through appropriate application of heat to the wafer 14. Obviously there is no limit to the artistic creativity that may be utilized to provide a coating on the wafer 14 so as to produce an unlimited number of different designs, each being an individually designed piece of jewelry.

Figure 6:
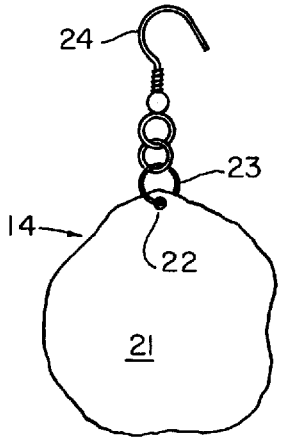
FIG. 6 is a front elevational view of the completed article of jewelry in the form of an earring.

Referring to FIG. 6, it will there be seen that the now completed wafer 14, with appropriate decorative coating 21 is provided with a small aperture 22 through which a suspension ring 23 is mounted, and which in turn is joined to additional mounting rings to provide a flexible connection between the wafer 14 and an earring suspension hook 24 as shown.

It will of course be understood that the method of creating this artistically created piece of jewelry involves the abrading or treatment of the surface of the wafer 14 after it has been pressed, depending upon the type of decorative coating 21 that it is intended to bond to the wafer. Thus, if the wafer is to be coated with a decorative enamel, merely cleaning the surface will usually be sufficient. On the other hand, if it is intended that a ceramic-type coating be bonded through the application of heat to the wafer, it is preferable that the wafer be abraded to remove any printed material that might be on the discarded bottle cap, such as the trademark or name of the soft drink or beer. In any event, the finished piece of jewelry, as illustrated in FIG. 6, is individualistic and attractive and embodies a great deal of artistic creativity.

Having thus described the invention, what is believed to be new and novel and sought to be protected by Letters Patent of the United States is as follows:

I claim:

1. An article of manufacture adapted for use as an adornment in the nature of an individualized article of jewelry, comprising:

a) a generally flat metallic wafer having an indiscriminately irregular surface and peripheral edge formed by the application of pressure from opposite directions to a conventional bottle cap having a top wall integral with an generally perpendicular to a crimped flange having a generally circular indiscriminately irregular periphery to fold portions of the crimped flange contiguously onto and about said top wall so as to generally occupy a common plane and thereby produce a generally flat wafer having an indiscriminately irregular surface and peripheral edge;

b. a decorative coating on said indiscriminately irregular surface and peripheral edge of said metallic wafer;

c. an aperture in said metallic wafer adjacent the indiscriminately irregular peripheral edge thereof; and d. means engaging the aperture in said wafer to enable suspension of the article of manufacture.

2. The article of manufacture according to claim 1, wherein said decorative coating applied to the indiscriminately irregular surface and peripheral edge of said metallic wafer is selected from the group consisting of powdered metal, pigmented enamel and ceramic.

* * * * *